US008395090B2

(12) United States Patent
Chiyoda

(10) Patent No.: US 8,395,090 B2
(45) Date of Patent: Mar. 12, 2013

(54) IMAGE HEATING APPARATUS HAVING A FIXING MEMBER AND FIRST AND SECOND EXTERNAL HEATING MEMBERS OR ROLLERS CONTACTING AN EXTERNAL SURFACE OF THE FIXING MEMBER AT DIFFERENT POSITIONS

(75) Inventor: Yasuharu Chiyoda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 240 days.

(21) Appl. No.: 12/834,511

(22) Filed: Jul. 12, 2010

(65) Prior Publication Data

US 2011/0006051 A1 Jan. 13, 2011

(30) Foreign Application Priority Data

Jul. 13, 2009 (JP) ..... 2009-164846

(51) Int. Cl.
*H05B 3/00* (2006.01)

(52) U.S. Cl. ..... 219/216

(58) Field of Classification Search ..... 219/216; 399/67–80

See application file for complete search history.

(56) References Cited

U.S. PATENT DOCUMENTS

| | | | | |
|---|---|---|---|---|
| 7,107,001 | B2 | 9/2006 | Kameda | |
| 7,366,456 | B2 * | 4/2008 | Yoshikawa | 399/329 |
| 7,593,678 | B2 * | 9/2009 | Suenaga | 399/323 |
| 7,636,527 | B2 * | 12/2009 | Nanba et al. | 399/69 |
| 7,653,322 | B2 * | 1/2010 | Maeda et al. | 399/69 |
| 7,725,047 | B2 * | 5/2010 | Maeda et al. | 399/69 |
| 7,783,218 | B2 * | 8/2010 | Maeda et al. | 399/69 |
| 7,860,419 | B2 * | 12/2010 | Tateishi et al. | 399/70 |
| 7,890,008 | B2 * | 2/2011 | Yamaji | 399/69 |
| 8,014,714 | B2 * | 9/2011 | Donald et al. | 399/333 |
| 8,019,247 | B2 * | 9/2011 | Mito et al. | 399/69 |
| 8,027,608 | B2 * | 9/2011 | Mukai et al. | 399/70 |
| 8,064,813 | B2 * | 11/2011 | Fromm et al. | 399/327 |
| 8,090,282 | B2 * | 1/2012 | Li et al. | 399/67 |
| 8,112,022 | B2 * | 2/2012 | Okamoto et al. | 399/325 |
| 8,150,306 | B2 * | 4/2012 | Kikuchi | 399/331 |
| 8,170,436 | B2 * | 5/2012 | Barton et al. | 399/69 |
| 8,175,485 | B2 * | 5/2012 | Ono | 399/88 |
| 2003/0021611 | A1 * | 1/2003 | Anthony et al. | 399/67 |
| 2003/0063916 | A1 * | 4/2003 | Katayanagi et al. | 399/44 |
| 2004/0028420 | A1 * | 2/2004 | Aslam et al. | 399/45 |

(Continued)

FOREIGN PATENT DOCUMENTS

| | | |
|---|---|---|
| JP | 55-002258 | 1/1980 |
| JP | 10-149044 | 6/1998 |
| JP | 11-038802 | 2/1999 |
| JP | 11-084934 | 3/1999 |

(Continued)

*Primary Examiner* — Nathan Ha

(74) *Attorney, Agent, or Firm* — Fitzpatrick, Cella, Harper & Scinto

(57) ABSTRACT

A fixing apparatus includes a fixing member for fixing an unfixed toner image on a sheet at a nip, a nip forming member for forming the nip cooperatively with the fixing member, a first heater for heating an external surface of the fixing member by contacting the external surface of the fixing member at a first position, and a second heater provided at a position upstream of the nip and downstream of the first position in a rotational direction of the fixing member, and for heating an external surface of the fixing member by contacting the external surface of the fixing member at a second position. The first heater has a thermal capacity larger than the second heater.

20 Claims, 8 Drawing Sheets

U.S. PATENT DOCUMENTS

| | | | | |
|---|---|---|---|---|
| 2007/0297825 | A1* | 12/2007 | Kostyk et al. | 399/67 |
| 2010/0329708 | A1* | 12/2010 | Aslam et al. | 399/45 |
| 2011/0020024 | A1* | 1/2011 | Berg et al. | 399/67 |
| 2011/0069984 | A1* | 3/2011 | Watanabe | 399/67 |

FOREIGN PATENT DOCUMENTS

| | | |
|---|---|---|
| JP | 2004-037555 | 2/2004 |
| JP | 2005-316421 | 11/2005 |

* cited by examiner

IMAGE HEATING APPARATUS HAVING A FIXING MEMBER AND FIRST AND SECOND EXTERNAL HEATING MEMBERS OR ROLLERS CONTACTING AN EXTERNAL SURFACE OF THE FIXING MEMBER AT DIFFERENT POSITIONS

FIELD OF THE INVENTION AND RELATED ART

The present invention relates to an image heating apparatus which has a heating member, a pressing member to be pressed upon the heating member to form the heating nip for heating a recording medium, and multiple external heating members for heating the heating member, and in which the multiple external heating members are in the immediate adjacencies of the peripheral surface of the heating member. More specifically, it relates to control of the apparatus for minimizing the reduction in the temperature of the heating nip when a recording medium is conveyed through the heating nip.

Image forming apparatuses which fix a toner image to a sheet of a recording medium by conveying the sheet of the recording medium between a heating member and a pressing member while keeping the sheet of the recording medium pinched by the heating and pressing members are widely in use. An image heating apparatus is mounted in an image forming apparatus not only for heating an unfixed toner image to fix the unfixed toner image, but also, for reheating a temporarily or permanently fixed toner image to adjust the image in glossiness. Regarding the type of heating member and the type of pressing member, there are image heating apparatuses having a combination of a heating roller and a pressing roller positioned as shown in FIG. 2, image heating apparatuses having a combination of a heating roller and a pressing belt, image heating apparatuses having a combination of a heating belt and a pressing belt, etc.

In recent years, it has come to be demanded by consumers that image forming apparatuses be much faster in process speed (image formation speed) and also, be much greater in print output per minute, and also, that image forming apparatuses be capable of forming images on thick paper and coated paper far better than they used to be. Generally, meeting these demands increases the reduction of the temperature of the heating nip as a recording medium is conveyed through the heating nip. Therefore, it is likely to result in fixation failure (Japanese Laid-open Patent Application H10-149044).

Japanese Laid-open Patent Application H10-149044 discloses a fixing apparatus (9). This fixing apparatus (9) has a heating roller (40) and a pressure roller (41), and is structured so that the two rollers (40) and (41) are separable from each other. More specifically, it is also provided with an external heat roller (unshown), which is 90° upstream of the heating nip (N) in terms of the rotational direction of the heat roller (40) and is separable from the heat roller (40). The external heat roller (unshown) is enabled to directly heat the peripheral surface of the heating roller (40). Thus, the fixing apparatus (9) can be prevented from suffering from the problem that as multiple sheets of a recording medium (P) pass through the heating nip (N), the heating nip (N) significantly decreases in temperature.

Japanese Laid-open Patent Application 2004-37555 discloses a fixing apparatus (9) which is different from the above described one. To describe this fixing apparatus (9) with reference to FIG. 2, this fixing apparatus (9) is provided with two external heat rollers (53) and (54), which are in the adjacencies of the peripheral surface of the heat roller (40).

Thus, the peripheral surface of the heater roller (40) of this fixing apparatus (9) is more efficiently heated than that of the fixing apparatus (9) disclosed in Japanese Laid-open Patent Application H10-149044. The two external heat rollers (53, 54) are the same in structure and heating performance, and are simultaneously placed in contact with, or separated from, the heat roller (40).

The image heating apparatus disclosed in Japanese Laid-open Patent Application 2004-37555 also suffers from a problem similar to the above-described problem. That is, as a substantial number of sheets of very thick paper pass through the heating nip N, the heating hip N decreases in temperature by an amount large enough to result in fixation failure. Thus, in order to make an image heating apparatus capable of dealing with a large number of sheets of thick paper, its heat roller had to be increased in diameter and thickness of its wall, and also, its external heat rollers had to be increased in size, which made it necessary to increase the image heating apparatus in size, and therefore, made it difficult to mount the heating apparatus into conventional image forming apparatuses.

Thus, multiple image heating apparatuses, which were different in the combination of the external heat rollers placed in the adjacencies of the heat roller, were made, and were compared among themselves in terms of the tendency that their heating nips decrease in temperature as sheets of a recording medium pass through them. As a result, a combination of a heating member and a pressing member, and a structural arrangement therefor, which are significantly more effective to prevent a heat roller from decreasing in surface temperature than those disclosed in the above-mentioned documents were discovered. That is, it became evident that the decrease in the temperature of the heat nip can be drastically reduced by providing an image heating apparatus with multiple external heat rollers which are different in thermal capacity unlike the external heat rollers of the image heating apparatus disclosed in Japanese Laid-open Patent Application 2004-37555, and arranging the external heat rollers in a specific positional relationship.

SUMMARY OF THE INVENTION

The primary object of the present invention is to provide an image heating apparatus which is structured so that multiple external heat rollers are in the adjacencies of the peripheral surface of the heat roller as in some of the conventional heating apparatuses, and yet, produces a significantly smaller reduction in the temperature of the heat nip than conventional image heating apparatuses as sheets of a recording medium pass through the heat nip.

According to an aspect of the present invention, there is provided an image heating apparatus comprising a rotatable image heating member for heating an image of a recording material; a pressing member for pressing against the image heating member to form a nip for nipping and feeding the recording material; a first external heating member for pressing against an outer surface of the image heating member at a position upstream of the nip with respect to a rotational direction of the image heating member to heat the image heating member; and a second external heating member for pressing against the outer surface of the heating member at a position between the first external heating member and the heating nip to heat the image heating member, wherein the first external heating member has a thermal capacity larger than the second external heating member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described in detail with reference to the appended drawings. The present invention is applicable to any image heating apparatus, which is partially or mostly the same in structure as the image heating apparatuses in the following embodiments of the present invention, as long as the image heating apparatus is structured so that its upstream external heat roller is greater in thermal capacity than its downstream external heat roller.

That is, the present invention is applicable to an image forming apparatus having a combination of a heat belt and a pressure belt which are pressed upon each other, an image heating apparatus having a combination of a heat roller and a pressure belt which are pressed upon each other, an image heating apparatus having a combination of a heat belt and a pressure belt which are pressed upon each other, in addition to an image heating apparatus having a combination of a heat roller and a pressure roller which are pressed upon each other.

An image heating apparatus in accordance with the present invention is mountable in any image forming apparatus regardless of type, that is, whether the image forming apparatus is of the intermediary-transfer type or direct-transfer type, whether the image forming apparatus is of the sheet type or web type, whether the image forming apparatus is of the monochromatic type or full-color type, or whether the image forming apparatus is of the tandem type or a single-drum type. Further, with the addition of necessary devices, equipment, frame/shell, etc., an image forming apparatus having an image heating apparatus in accordance with the present invention can be used as a part of a printer, a copying machine, a facsimile machine, a multi-functional apparatus capable of functioning as two or more of the preceding apparatuses.

<Image Forming Apparatus>

Figure 1:
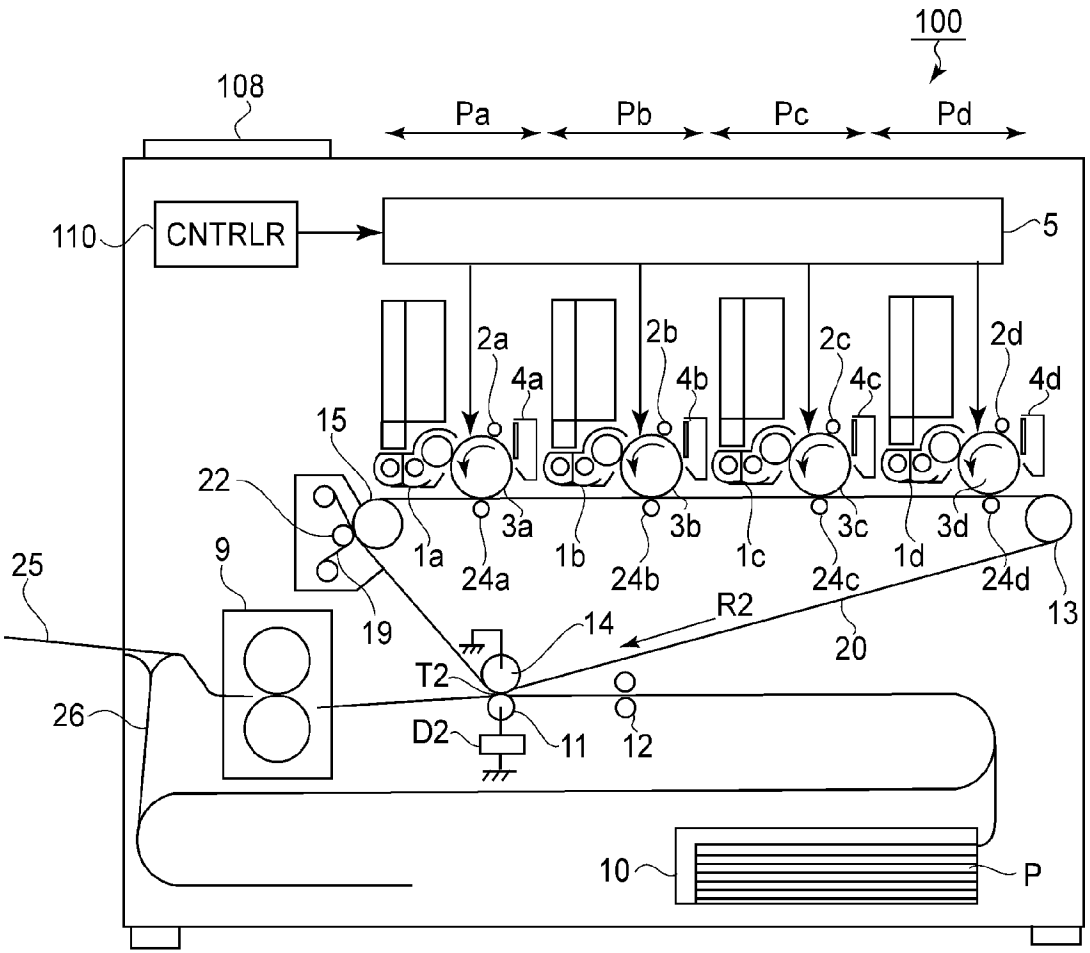
FIG. 1 is a schematic sectional view of the image forming apparatus in the first embodiment of the present invention, and shows the structure of the apparatus.

FIG. 1 is a schematic sectional view of the image forming apparatus in the first preferred embodiment of the present invention, and depicts the structure of the apparatus.

Referring to FIG. 1, the image forming apparatus 100 is a full-color printer having an intermediary transfer belt 20 and four image forming portions, that is, yellow, magenta, cyan, and black image forming portions Pa, Pb, Pc, and Pd, correspondingly. The four image forming portions are sequentially arranged along the intermediary transfer belt 20.

In the image forming portion Pa, a yellow toner image is formed on the photosensitive drum 3*a*, and is transferred (primary transfer) onto the intermediary transfer belt 20. In the image forming portion Pb, a magenta toner image is formed on the photosensitive drum 3*b*, and is transferred (primary transfer) onto the yellow toner image on the intermediary transfer belt 20. In the image forming portions Pc and Pd, cyan and black toner images are formed on the photosensitive drums 3*c* and 3*d*, respectively, and are sequentially transferred (primary transfer) in layers onto the yellow and magenta toner images layered on the intermediary transfer belt 20.

After the transfer (primary transfer) of the four monochromatic toner images, different in color, onto the intermediary transfer belt 20, the four toner images are conveyed by the transfer belt 20 to a secondary transfer portion T2, in which they are transferred all at once (secondary transfer) onto a sheet of a recording medium P while the recording medium P is conveyed through the secondary transfer portion T2, remaining pinched between the intermediary transfer belt 20 and a recording medium conveyer belt.

More specifically, each recording medium P is fed into the main assembly of the image forming apparatus 100 from a recording-medium cassette 10 in which multiple sheets of a recording medium P are stored in layers, while being separated from the rest. Then, the recording medium P is kept on standby by a pair of registration roller 12, which send the recording medium P to the secondary transfer portion T2 with such a timing that the recording medium P arrives at the secondary transfer portion T2 at the same time as the layered toner images on the intermediary transfer belt 20 arrive at the secondary transfer portion T2.

When the image forming apparatus 100 is in the one-side print mode, the recording medium P is conveyed to a fixing apparatus 9 after the transfer (secondary transfer) of a toner image (toner images) onto the recording medium P. In the fixing apparatus 9, the recording medium P and the toner image(s) thereon are subjected to heat and pressure, whereby the toner image(s) becomes fixed to the surface of the recording medium P. Then, the recording medium P is discharged into a delivery tray 25. When the image forming apparatus 100 is in the two-sided print mode, the recording medium P is turned over with the use of a switchback path 26 after the fixation of the toner image(s) to one (first) of the surfaces of the recording medium P in the fixing apparatus 9. Then, the recording medium P is sent again to the registration rollers 12, where it is kept on standby. Then, a toner image (toner images) are transferred onto the second surface (back surface) of the recording medium P, and fixed to the second surface, through the same steps as those involved in the transfer of a toner image(s) onto the first (front surface).

The image forming portions Pa, Pb, Pc, and Pd are virtually the same in structure, although they are different in the color of the toners which their developing apparatuses 1*a*, 1*b*, 1*c*, and 1*d* use in the image forming portions Pa, Pb, Pc, and Pd, respectively. Thus, only the yellow image forming portion Pa will be described. As for the description of the other image forming portions Pb, Pc, Pd, the last letter (a) of the reference codes for the structural components of the image forming portion Pa shall be replaced with b, c, and d, respectively.

The image forming portion Pa has a photosensitive drum 3*a*. It has also a charge roller 2*a*, an exposing apparatus 5, a developing apparatus 1*a*, a primary transfer roller 24*a*, and a cleaning apparatus 4*a*, which are disposed in the adjacencies of the peripheral surface of the photosensitive drum 3*a* in a manner to surround the photosensitive drum 3*a*.

The charge roller 2*a* is rotated by the rotation of the photosensitive drum 3*a* by being placed in contact with the photosensitive drum 3*a*. As an oscillatory voltage, which is a combination of a DC voltage and an AC voltage, is applied to the charge roller 2*a* while the charge roller 2*a* is rotated, the charge roller 2*a* uniformly and negatively charges the peripheral surface of the photosensitive drum 3*a* to a preset potential level. The exposing apparatus 5 writes an electrostatic image of the image to be formed, on the charged portion of the peripheral surface of the photosensitive drum 3*a*, by scanning the uniformly charged area of the peripheral surface of the photosensitive drum 3*a* with the beam of laser light while modulating (turned on or off) the beam of laser light with the image data, and by deflecting the beam of laser light with its rotational polygonal mirror.

The developing apparatus 1*a* makes its development sleeve bear the two-component developer it contains, while charging the two-component developer by stirring the developer, in such a manner that the developer borne on the development sleeve will rub the peripheral surface of the photosensitive drum 3*a*. As an oscillatory voltage, which is a combination of a negative DC voltage and an AC voltage, is applied to the development sleeve, the negatively charged toner on the development sleeve transfers onto the peripheral surface of the photosensitive drum 3*a*, developing in reverse the electrostatic image on the photosensitive drum 3*a*.

The primary transfer roller 24*a* is on the inward side of the loop which intermediary transfer belt 20 forms. It is in contact with the inward surface of the intermediary transfer belt 20. It presses the intermediary transfer belt 20 against the photosensitive drum 3*a*, whereby it forms the toner image transferring primary portion (which hereafter will be referred to simply as the primary transfer portion) between the intermediary transfer belt 20 and the photosensitive drum 3*a*. As a positive DC voltage is applied to the primary transfer roller 24*a*, the negatively charged toner image on the photosensitive drum 3*a* is transferred (primary transfer) onto the intermediary transfer belt 20.

The secondary transfer roller 11 is pressed upon the portion of the intermediary transfer belt 20, which is backed up by a backup roller 14 located within the loop which the belt 20 forms. It forms a toner image transferring secondary portion T2 (which hereafter will be referred to simply as the secondary transfer portion T2) between the intermediary transfer belt 20 and secondary transfer roller 11. An electric power source D2 transfers all at once (secondary transfer) the four monochromatic toner images, different in color, on the intermediary transfer belt 20, onto the recording medium P, by applying a positive voltage to the secondary transfer roller 11.

The cleaning apparatus 4*a* recovers the transfer residual toner, that is, the toner remaining on the peripheral surface of the photosensitive drum 3*a* after the primary transfer, by placing its cleaning blade in contact with the peripheral surface of the photosensitive drum 3*a*. The belt cleaning apparatus 22 wipes away foreign substances, such as the transfer residual toner, remaining on the intermediary transfer belt 20, by placing its cleaning web 19 (unwoven cloth) in contact with the surface of the intermediary transfer belt 20.

<Fixing Apparatus>

Figure 2:
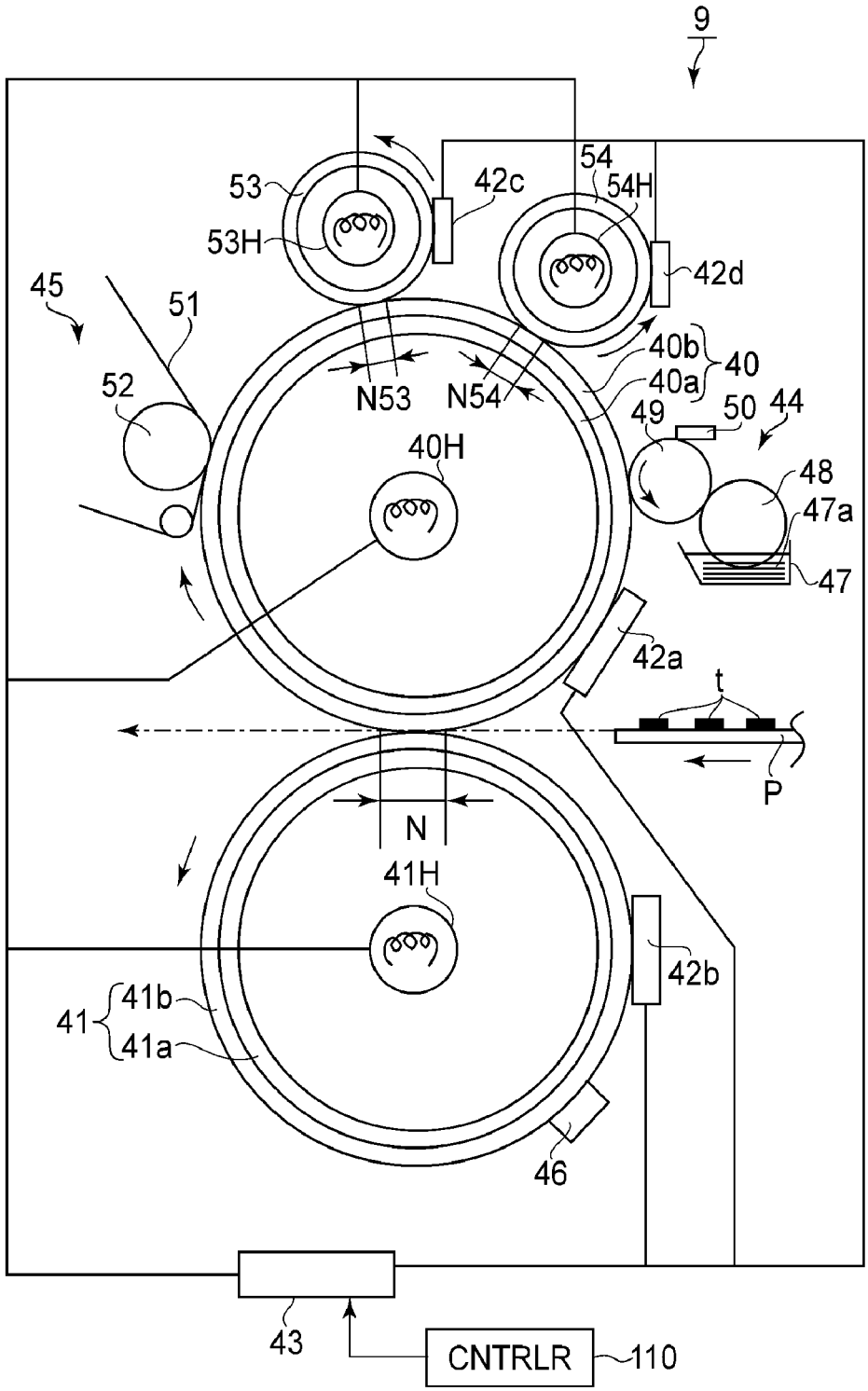
FIG. 2 is a schematic sectional view of the fixing apparatus in the first embodiment, and shows the structure of the apparatus.
Figure 3:
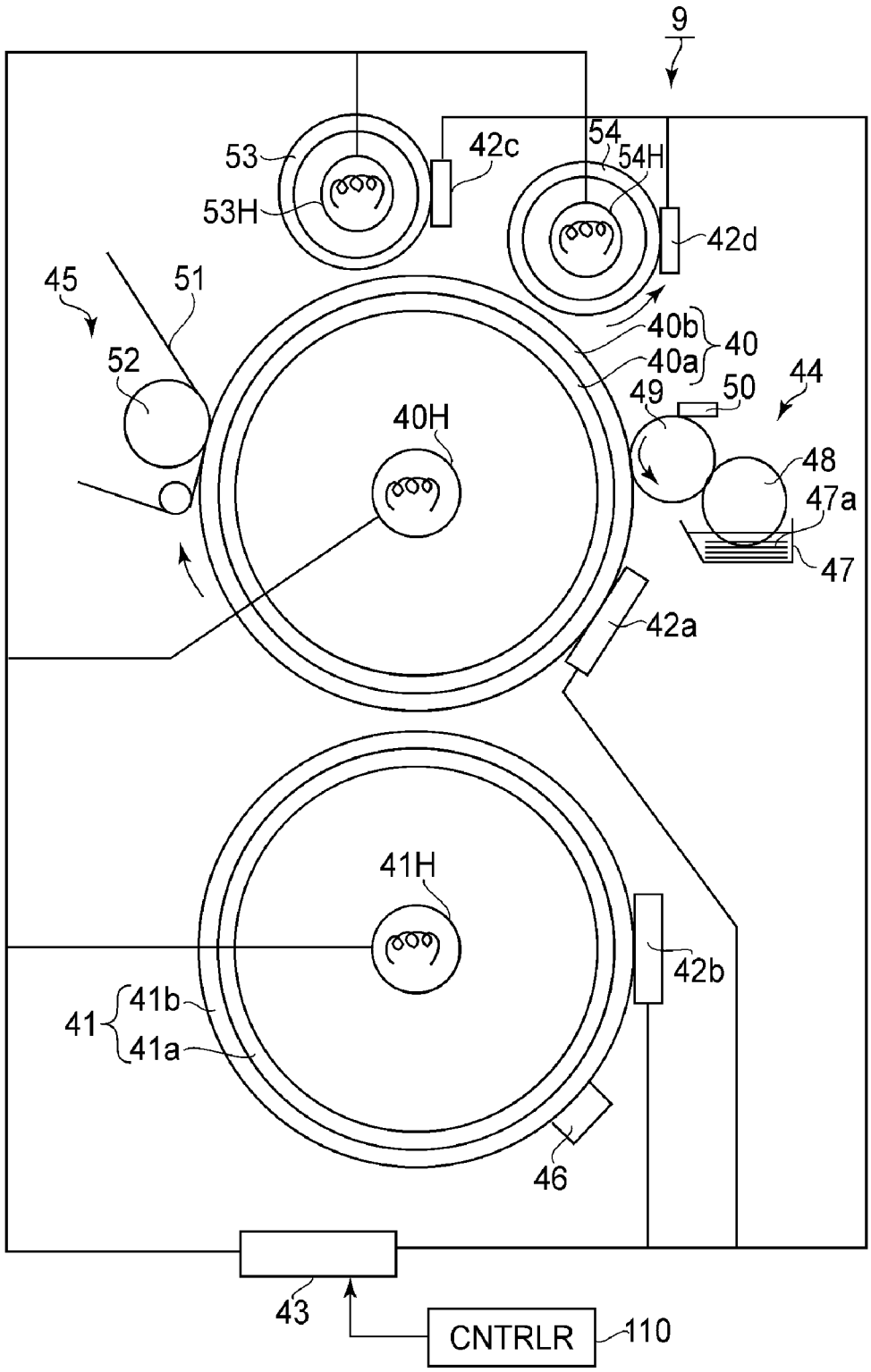
FIG. 3 is a schematic sectional view of the image heating apparatus in the first embodiment, and shows the state of the apparatus when the heat roller and the pressure roller of the apparatus are not in contact with each other.
Figure 4:
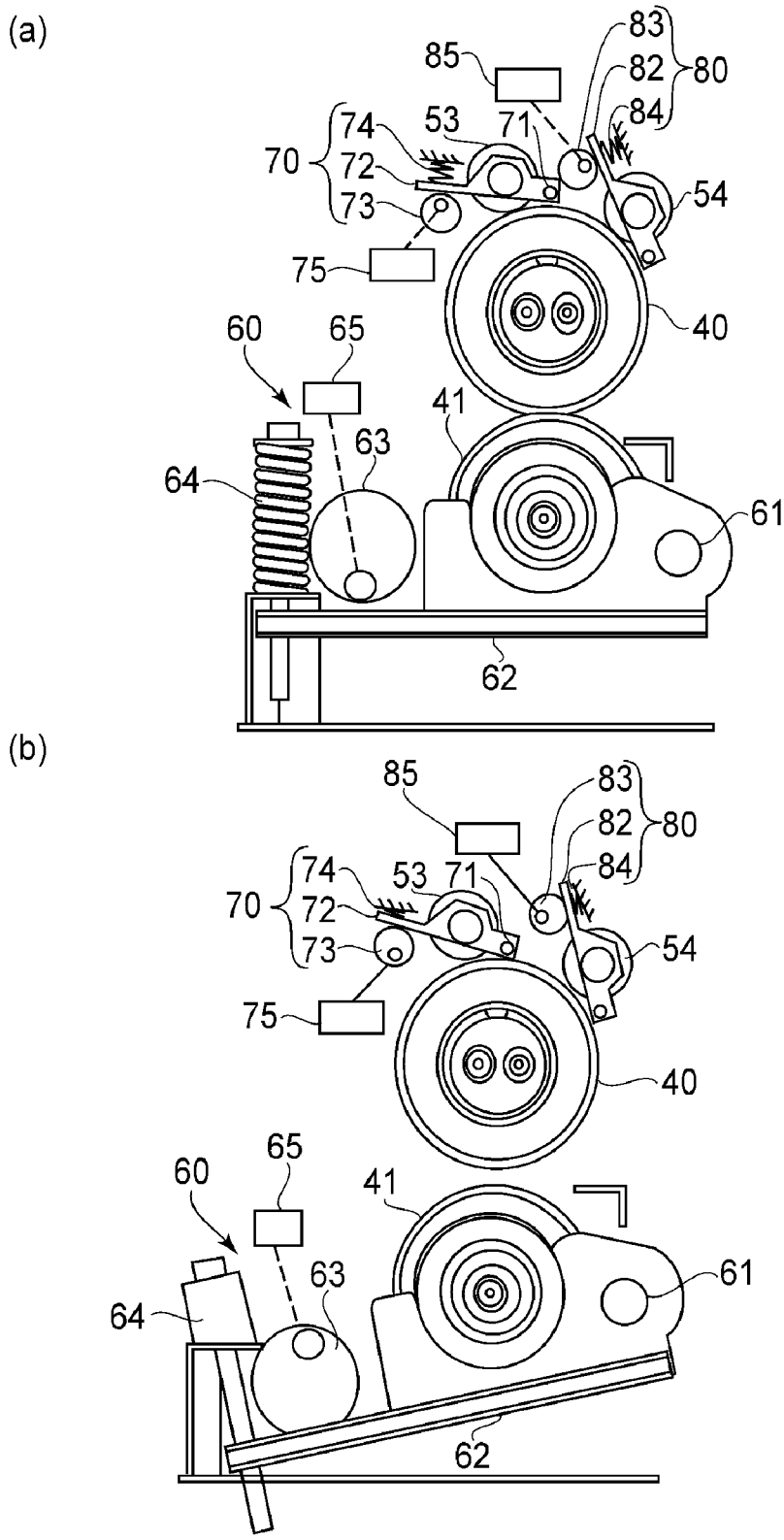
FIGS. 4(*a*) and 4(*b*) are schematic drawings of the fixing apparatus in the first embodiment, and show the mechanism for pressing its pressing roller upon its fixation roller, or separating the pressing roller from the fixation roller, and show the structure of the mechanism.

FIG. 2 is a schematic sectional view of the fixing apparatus in the first embodiment, and depicts the structure of the apparatus. FIG. 3 is a schematic sectional view of the fixing apparatus in the first embodiment, and depicts the state of the apparatus when the heat roller and the pressure roller of the apparatus are not in contact with each other. FIGS. 4(*a*) and 4(*b*) are schematic drawings of the fixing apparatus in the first embodiment, in particular, its mechanism for placing its heat roller and the pressure roller in contact with each other, or separating them from each other.

Referring to FIG. 2, after an unfixed toner image t is transferred (secondary transfer) onto the recording medium P, the recording medium P and the unfixed toner image t thereon are conveyed through the heating nip N which the fixation roller 40 (image heating member) and pressure roller 41 (image pressing member) form between them, while remaining pinched by the two rollers 40 and 41. As the recording medium P and the unfixed image t thereon is conveyed through the heating nip N, the unfixed toner image t is fixed to the recording medium P. The fixing apparatus 9 (image heating apparatus) is made up of the fixation roller 40 and the pressure roller 41, which are pressed upon each other with the application of a total amount of pressure of roughly 784 N (roughly 80 kg) to form the heating nip N.

The fixation roller 40 is 60 mm in diameter. It is made up of a metallic core 40*a* and an elastic layer 40*b*. The metallic core 40*a* is cylindrical and is made of aluminum. The elastic layer is 3 mm in thickness, and is formed on the peripheral surface of the metallic core 40*a* in a manner to completely cover the peripheral surface of the metallic core 40*a*. The elastic layer 40*b* has top and bottom sublayers. The bottom sublayer is formed of silicon rubber of the HTV (high temperature vulcanization rubber) type. The top sublayer is formed of silicon rubber of the RTV (room temperature vulcanization rubber) type, and is on the outward surface of the sublayer made of silicon rubber of the HTV type. That is, the top sublayer is the layer which is placed in contact with the image bearing surface of the recording medium P, and the toner image thereon.

The pressure roller 41 is 60 mm in diameter. It is made up of a metallic core 41*a* and an elastic layer 41*b*. The metallic core 41*a* is cylindrical and is formed of aluminum. The elastic layer 41*b* is 1 mm in thickness and is formed on the peripheral surface of the metallic core 41*a* in a manner to completely cover the peripheral surface of the metallic core 40*a*. The elastic layer 41*b* has top and bottom sublayers. The bottom sublayer is formed of silicon rubber of the HTV type. The top sublayer is formed of fluorinated resin, and covers the entirety of the peripheral surface of the outward surface of the bottom sublayer.

The fixation roller 40 is provided with a halogen heater 40H, which is stationary and is in the hollow of the fixation roller 40, being positioned so that its axis coincides with the rotational axis of the fixation roller 40, to heat the fixation roller 40 from within the fixation roller 40. The pressure roller 41 is provided with a halogen heater 41H, which is stationary and is in the hollow of the pressure roller 41, being positioned so that its axis coincides with the rotational axis of the pressure roller 41, to heat the pressure roller 41 from within the fixation roller 41.

The fixation roller 40 and the pressure roller 41 are rotatably supported by two pairs of ball bearings by their lengthwise ends, one for one. They are indirectly in connection with each other through an unshown gear driving mechanism, which meshes with the gear attached to one of the lengthwise end of the fixation roller 40 and the gear attached to one of the lengthwise end of the pressure roller 41. The two rollers 40 and 41 are rotationally driven together by unshown driving system in the directions indicated by a pair of arrow marks one for one.

There is a thermistor 42*b* (detecting means) on the upstream side on the heating nip N in terms of the rotational direction of the pressure roller 41. The thermistor 42*b* is in contact with the peripheral surface of the pressure roller 41, and is connected to a temperature adjustment circuit 43 (temperature adjusting means), which adjusts the amount of electric power supplied to the halogen heaters, in such a manner that the surface temperature of the peripheral surface of the pressure roller 41 detected by the thermistor 42*b* converges to a preset level (roughly 140° C.).

Further, there is a thermistor 42*a* (detecting means) on the upstream side on the heating nip N in terms of the rotational direction of the fixation roller 40, and on the downstream side of the external heat roller 54. The thermistor 42*a* is in contact with the peripheral surface of the fixation roller 40, and is connected to a temperature adjustment circuit 43 (temperature adjusting means), which adjusts the amount of electric power supplied to the halogen heaters, in such a manner that the surface temperature of the peripheral surface of the fixation roller 40 detected by the thermistor 42*a* converges to a preset level (roughly 165° C.).

The developing apparatuses 1*a*, 1*b*, 1*c*, and 1*d* of the image forming apparatus 100 use color toners of the so-called sharp-melt type. The color toner of the sharp-melt type has a low melting point. Further, it is low in viscosity when it is in liquid state. Therefore, when it is in liquid state, it has high affinity to the peripheral surface of the fixation roller 40; it tends to adhere to the fixation roller 40. Thus, the peripheral surface of the fixation roller 40 is coated with oil by an oil applying apparatus 44 to prevent the color toner of the sharp-melt type from adhering to the peripheral surface of the fixation roller 40. The cleaning apparatus 45 of the web type has an unwoven web 51 supported by a pressure roller 52. It places the unwoven web 51 in contact with the peripheral surface of the fixation roller 40 so that as the fixation roller 40 is rotated, the excessive amount of oil and contaminants on the fixation roller 40 will be wiped away by the unwoven web 51.

A cleaning blade 46 is placed in contact with the peripheral surface of the pressure roller 41 to remove the oil and contaminants on the peripheral surface of the pressure roller 41 to ensure that as the recording medium P and the toner image thereon comes out of the heating nip, they will cleanly part from the peripheral surface of the pressure roller 41. That is, the cleaning blade 46 helps the pressure roller 41 part the recording medium P from its peripheral surface.

Combining the fixation roller 40 and the pressure roller 41, which have a laminar structure, further ensures that as the recording medium P comes out of the fixing apparatus 9, the toner of the sharp-melt type cleanly parts from the rollers 40 and 41. Further, in order to satisfactorily fix an unfixed toner on both surfaces of the recording medium P, not only is the elastic layer of the fixation roller 40 made up of a sublayer made of silicon rubber of the HTV type and a sublayer made of silicon rubber of the RTV type, but also, the elastic layer of the pressure roller 41 is made of the same combination of sublayers.

However, the silicon rubber of the RTV type, which is used as the material for the parting (top) layer of the elastic layer of the fixation roller 40, and the parting (top) layer of the elastic layer of the pressure roller 41, and the silicon rubber of the HTV type used as the material for the elastic layer (bottom) layer of the fixation roller 40 to form the heating nip N capable of wrapping around the toner image formed of sharp-melt type toner, are both high affinity to silicone oil by nature. Therefore, silicon oil is absorbed by the elastic layers. Thus, as the cumulative number of prints yielded with the use of the fixing apparatus 9 increases, the amount of silicon oil in the silicon rubber layers of the fixation roller 40 and the pressure roller 41, in particular, the bottom sublayers made of silicon rubber of the HTV type becomes substantial. With the increase in the amount of silicon oil in the bottom sublayers made of silicon rubber of the HTV type (bottom layers), it is possible that the elastic layers of the fixation roller 40 and the pressure roller 41 will separate from the metallic cores 40*a* and 41*a*, respectively, when the fixing apparatus 9 is performing a heating operation.

In this embodiment, therefore, in order to prevent this separation problem when the image forming apparatus 100 is required to continuously output a large number of copies at a high speed, both the fixation roller 40 and the pressure roller 41 are provided with a layer of fluorinated rubber, which is layered between the bottom sublayer made of silicon rubber of the HTV type and the top sublayer made of silicon rubber of the RTV type. The fluorinated rubber layer does not absorb silicon oil. It functions as a layer which blocks silicon oil.

In recent years, color copying machines have come to be widely used. As the usage of color copying machines has become widespread, color copying machines have come to be required to be as fast and convenient as black-and-white copy machines. Further, various special functions, such as automatically forming two-sided copies, have become mandatory functions for color copy machines. Further, they have come to be required to be capable of dealing with many types of recording media P, for example, recording media different in size, ranging from a postcard size to a very large size, recording media different in basis weight (weigh per unit area), ranging from very thin paper to very thick paper, and recording media different in material, for example, OHP film, packaged print film, etc.

In other words, the image forming apparatuses (100) have come to be required to be highly productive (in terms of print count per unit length of time) regardless of size and type of the recording medium. Thus, in order to improve image forming apparatuses in productivity, in particular, in terms of the productivity when a recording medium of a heavy basis weight is used, it is required to increase the fixing apparatus (9) in fixation speed.

However, when the recording medium P has a heavy basis weight, a large amount of heat is absorbed by the recording medium P in the heating nip. Therefore, when the recording medium P has a heavy basis weight, the amount of heat required for fixation is substantially greater than when the recording medium P is thin paper (light in basis weight). Therefore, currently, when the recording medium P has a heavy basis weight, that is, when it is necessary to fix a toner image to recording medium P which is thick, and therefore, large in thermal capacity, the image forming apparatus 100 reduces the speed with which the recording medium P is conveyed through the heating nip N for fixation; in other words, the productivity of the image forming apparatus 100 is reduced.

One of the methods thinkable as a means for making it unnecessary to reduce the speed with which the recording medium P is conveyed through the heating nip (fixation nip) even when the recording medium P is substantial in basis weight, that is, the method for making it unnecessary to reduce the productivity of the image forming apparatus 100, is to increase the fixation roller 40 and pressure roller 41 in diameter, for example, to 80 mm so that the heating hip N becomes longer in terms of the direction in which the recording medium P is conveyed.

However, increasing the fixation roller 40 and the pressure roller 41 in size requires the fixing apparatus 9 to be increased in size, which makes it impossible for the fixing apparatus 9 to be mounted in the image forming apparatus 100. Another method proposed is to increase the target temperature of the fixing apparatus (9) for the fixation roller 40 to improve the fixation performance of the fixing apparatus (9) performance. However, this method is problematic in that the increase in the target temperature for the fixation roller 40 causes the sharp-melt type toner to transfer (offset) onto the fixation roller 40, which results in the outputting of images that are lower in image density than expected. Further, it sometimes causes the problem that thin recording medium jams the fixing apparatus (9) by being adhered to the fixation roller 40.

In this embodiment, therefore, the image forming apparatus 100 is provided with a pair of external heat rollers 53 and 54 for directly heating the peripheral surface of the fixation roller 40, in order to make it possible to satisfactorily fix a toner image to the recording medium P without reducing the speed with which the recording medium P is conveyed through the heating nip N, even when the recording medium P is thick paper.

<External Heat Rollers>

Referring to FIG. 2, the image forming apparatus 100 is provided with a pair of external heat rollers 53 and 54 (external heating members), which are in the adjacencies of the peripheral surface of the fixation roller 40 and can be placed in contact with, or separated from, the peripheral surface of the fixation roller 40 independently from each other. The mechanism for placing the two rollers 53 and 54 in contact with, or separating from, the fixation roller 40 will be described later. In terms of the rotational direction of the fixation roller 40, the external heat rollers 53 and 54 are positioned on the upstream side of the heating nip N, and further, the external heat roller 53 is placed in contact with the fixation roller 40 on the upstream side of the external heat roller 54.

The surface rubber layer of the fixation roller 40 is low in thermal conductivity. Therefore, when the recording medium P is thick, the amount of the heat supplied to the surface of the fixation roller 40 is insufficient to compensate for the amount of heat absorbed from the fixation roller 40 by the recording medium P in the heating nip N. In this embodiment, therefore, the external heat rollers 53 and 54 are provided for the purpose of keeping constant the surface temperature of the fixation roller 40. That is, in order to increase the image forming apparatus 100 in speed, the fixing apparatus 9 of the image forming apparatus 100 is provided with the pair of external heat rollers 53 and 54 to increase the amount of heat provided to the surface of the fixation roller 40.

The external heat rollers 53 and 54 are provided with halogen heaters 53H and 54H, respectively, which are stationary and are in the internal spaces of the rollers 53 and 54 to heat them from within to make the rollers 53 and 54 higher in surface temperature than the fixation roller 40, respectively. The external heat rollers 53 and 54 are supported by highly heat resistant and thermally nonconductive bushes at their lengthwise ends. They are made of a metallic cylinder and a surface layer. The metallic cylinder is formed of a thermally highly conductive metal such as aluminum, iron, stainless steel, and the like. The surface layer is formed of highly slippery rubber, resin, or the like. During an image forming operation, the nip N53 between the external heat roller 53 and fixation roller 40, and the nip N54 between the external heat roller 54 and fixation roller 40, are roughly 5 mm in width (width of contact) in terms of the rotational direction of the fixation roller 40, making the total width of the combination of the two fixation roller heating nips roughly 10 mm wide.

The fixing apparatus 9 is provided with a pair of thermistors 42*c* and 42*d*, which are means for detecting the surface temperature of the external heat rollers 53 and 54, respectively. The two thermistors 42*c* and 42*d* are in contact with the peripheral surfaces of the external heat rollers 53 and 54, respectively. During an image forming operation, the amount of electric power supplied to the halogen heaters 53H and 54H according to the temperature information outputted by the thermistors 42*c* and 42*d* is controlled by a temperature adjustment circuit 43 so that the surface temperature of the external heat rollers 53 and 54 converges to the target level.

The target temperature levels for the external heat rollers 53 and 54 are the same, and are set so that they are higher than that of the fixation roller 40 as the heating member. For example, when the target temperature level for the fixation roller 40 is 160° C., the target temperature levels for the external heat rollers 53 and 54 are set to 230° C., because keeping the external heat rollers 53 and 54 higher in temperature than the fixation roller 40 makes the temperature adjustment circuit 43 quicker in response (accuracy in thermal response) to the drop in the surface temperature of the fixation roller 40, and therefore, the fixation roller 40 is more precisely supplied with heat by the external heat rollers 53 and 54 than otherwise. This is why the target temperature levels for the external heat rollers 53 and 54 are set higher by 60° C. than that for the fixation roller 40, in this embodiment.

The temperature adjustment circuit 43 functions as both first and second controlling means, which are for controlling the temperature of the fixation roller 40 and pressure roller 41, respectively. The target temperature levels for the external heat rollers 53 and 54, which are controlled in temperature by the second controlling means, are set higher than the target temperature level for the fixation roller 40, which is controlled in temperature by the first controlling means.

Next, referring to FIG. 4(*a*), a mechanism 60 for placing the external heat rollers 53 and 54 in contact with, or separating them from, the fixation roller 40 rotatably supports the pressure roller 41 with a pair of pressure roller supporting arms 62, which are rotationally movable about an axle 61 (hereafter, the mechanism 60 will be referred to simply as contact/separation mechanism 60). The pressure roller 41 is kept pressed upon the fixation roller 40 by the pressure applied to the pressure roller 41 by a pressure applying mechanism 64 made up of a pair of compression springs. Referring to FIG. 4(*b*), as a motor rotates an eccentric cam 63, the pressure roller 41 is separated from the fixation roller 40 against the resiliency of the springs of the pressure applying mechanism 64.

Similarly, the contact/separation mechanisms 70 and 80 rotatably support the external heat rollers 53 and 54 with arms 72 and 82, which are rotationally movable about the axles 71 and 81, respectively. The external heat rollers 53 and 54 are kept pressed upon the fixation roller 40 by pressing mechanisms 74 and 84, respectively, made up of a pair of compression springs. The total amount of contact pressure between the external heat roller 53 and the fixation roller 40, and that between the external heat roller 54 and fixation roller 40, are both roughly 392 N (40 kg). The external heat rollers 53 and 54 are rotated by the rotation of the fixation roller 40.

Referring to FIG. 4(*b*), as a motor 75 rotates an eccentric cam 73, the external heat roller 53 is separated from the fixation roller 40 against the resiliency of the springs of the pressing mechanism 74. Further, as a motor 85 rotates an eccentric cam 83, the external heat roller 54 is separated from the fixation roller 40 against the resiliency of the springs of the pressing mechanism 84.

Next, referring to FIG. 3, when the fixing apparatus 9 is on standby (during an image forming operation), the pressure roller 41, the external heat roller 53, and the external heat roller 54 are kept separated from the fixation roller 40.

<Embodiment 1>

Figure 5:
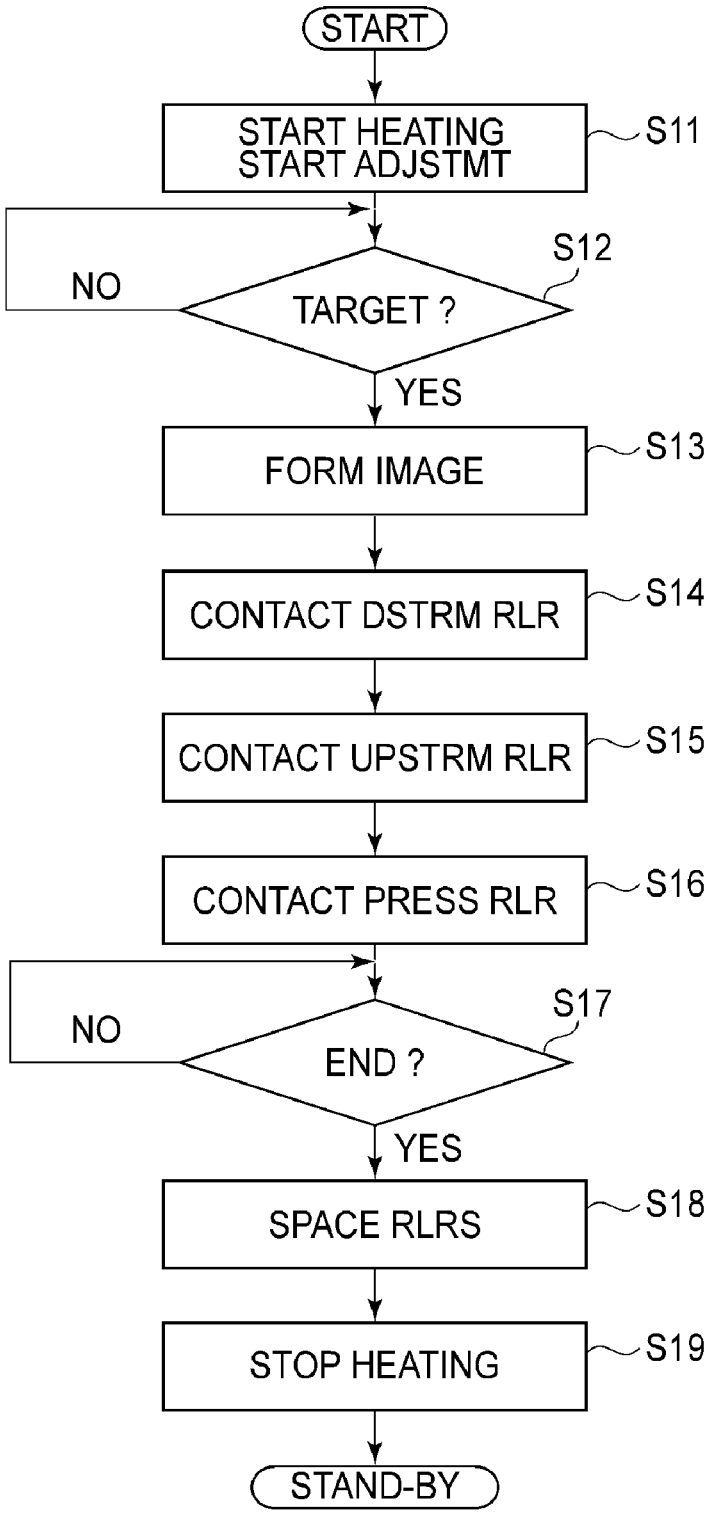
FIG. 5 is a flowchart of the control sequence, in the first embodiment, for controlling the fixing nip in temperature.
Figure 6:
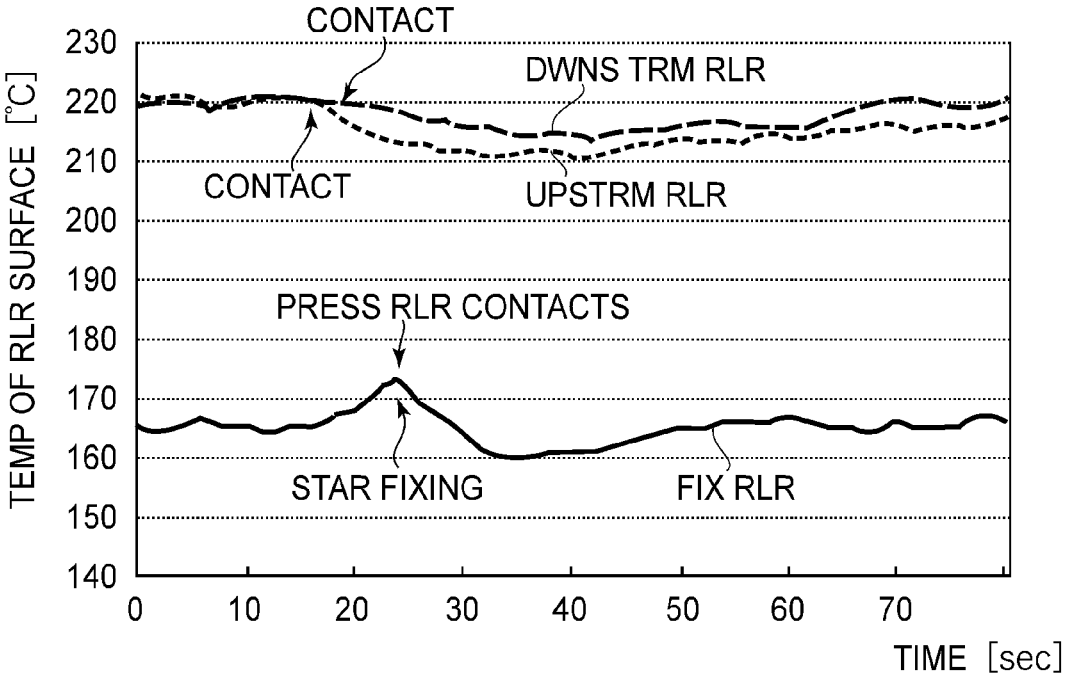
FIG. 6 is a graph which shows the relationship between the fluctuation in the surface temperature of the fixation roller of the fixing apparatus in the first embodiment, which occurred when multiple sheets of ordinary paper were conveyed through the fixation nip for the fixation of the images thereon, and the elapse of time.
Figure 7:
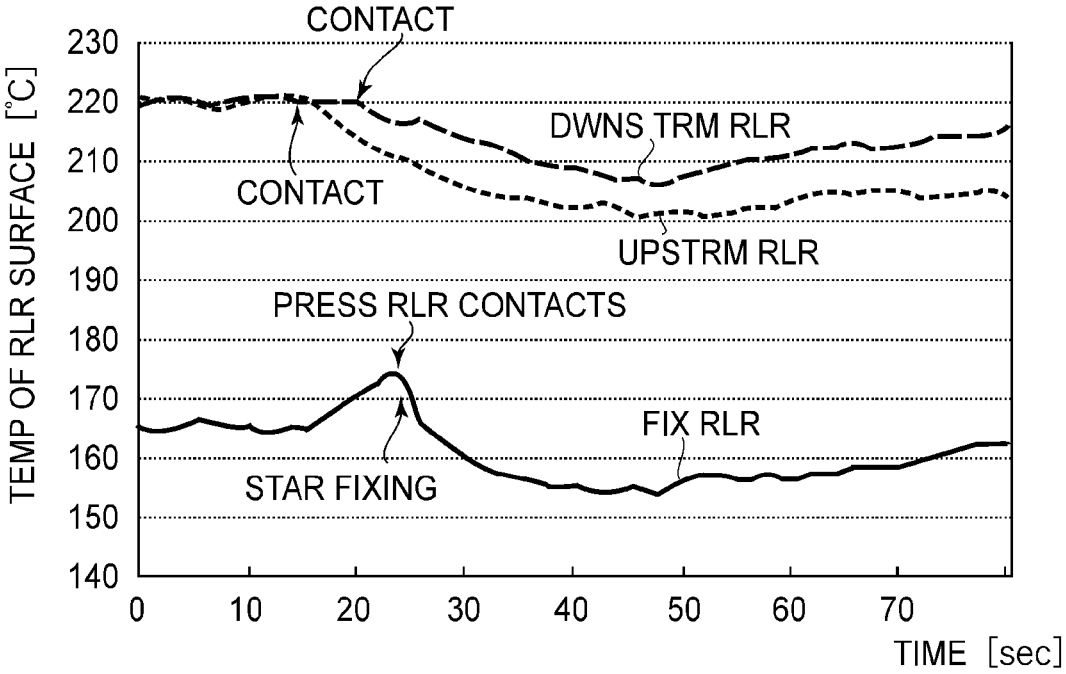
FIG. 7 is a graph which shows the relationship between the fluctuation in the surface temperature of the fixation roller of the fixing apparatus in the first embodiment, which occurred when multiple sheets of thick paper were conveyed through the fixation nip for the fixation of the images thereon, and the elapse of time.

FIG. 5 is a flowchart of the control sequence in the first preferred embodiment of the present invention. FIG. 6 is a graph which shows the relationship between the fluctuation of the surface temperature of the fixation roller, which occurred when multiple sheets of ordinary paper were conveyed through the fixation nip for the fixation of the images thereon, and the elapse of time. FIG. 7 is a graph which shows the relationship between the fluctuation of the surface temperature of the fixation roller of the fixing apparatus in the first embodiment, which occurred when multiple sheets of thick paper were conveyed through the fixation nip for the fixation of the images thereon, and the elapse of time.

One of the thinkable means for keeping the image forming apparatus 100 as high in productivity when the recording medium P is thick paper, as when the recording medium P is thin paper is to increase the amount of heat applied to the surface of the fixation roller 40 from the external heat rollers 53 and 54. However, simply increasing the amount of heat supplied to the fixation roller 40 from the external heat rollers 53 and 54 makes it possible that before the recording medium P enters the heating nip N, the surface of the fixation roller 40 is supplied with an excessive amount of heat by the external heat rollers 53 and 54.

In other words, simply increasing the amount of heat supplied to the fixation roller 40 from the external heat rollers 53 and 54 makes is possible that the surface temperature of the fixation roller 40 will become too high, and therefore, excessively melt the toner on the recording medium P, which will result in the outputting of images which are too high in glossiness. The problem that the fixation roller 40 becomes excessively high in surface temperature cannot be solved by the alternation alone of the target temperatures for the temperature control of the fixation roller 40 and external heat roller 53 and 54, because the external heat rollers 53 and 54, and the fixation roller 40, do not quickly change in surface temperature.

Further, if the external heat rollers 53 and 54 are simultaneously placed in contact with the fixation roller 40, the amount of heat that flows from the first external heat roller 53 into the fixation roller 40 is greater than the amount of heat that flows from the second external heat roller 54 into the fixation roller 40. Therefore, the first external heat roller 53 decreases in temperature, reducing thereby in its ability to heat the surface layer of the fixation roller 40. Consequently, the fixing apparatus 9 becomes unsatisfactory in fixation.

Thus, it was tried to place the external heat rollers 53 and 54 in contact with the fixation roller 40 to give heat to the fixation roller 40 after the recording medium P began to enter the heating nip N. In this case, however, the surface temperature of the fixation roller 40 decreased too much immediately after the recording medium P began to rob heat from the fixation roller 40. Therefore, the fixation roller 40 could not melt the toner on the recording medium P. Consequently, images that are insufficient and/or nonuniform in glossiness were outputted sometimes.

More specifically, in the case of the first comparative fixing apparatus, which was conventionally structured, the surface layer of the fixation roller 40 could not be effectively heated by the external heat rollers 53 and 54, and therefore, the image forming apparatus 100 could not be improved in productivity. Further, the image forming apparatus 100 outputted color images which were nonuniform in glossiness; it failed to output color images of high quality.

In the first embodiment, therefore, the first external heat roller 53 was made greater in thermal capacity than the second external heat roller 54, by making the external heat rollers 53 and 54 different in diameter and by selecting the materials for the external heat rollers 53 and 54 in such a manner that the material for the external heat roller 53 became different in specific heat from that for the external heat roller 54.

The second external heat roller 54 was made up of a metallic core and a fluorinated resin (PFA) layer. The metallic core was a piece of aluminum cylinder which was 36 mm in diameter and 3.0 mm in thickness (AL6063: 2.7 in specific gravity, and 900 [J/kg.K] in specific heat). The fluorinated resin was coated on the peripheral surface of the metallic core to a thickness of roughly 20 μm. As for the first external heat roller 53, it also was made up of a metallic core and a fluorinated resin (PFA) layer. The metallic core was a piece of stainless steel cylinder which was 43 mm in diameter and 3.0 mm in thickness (SUS430: 7.9 in specific gravity, and 444 [J/kg·K] in specific heat). The fluorinated resin was coated on the peripheral surface of the metallic core to a thickness of roughly 20 μm.

Thus, the thermal capacity of the first external heat roller 53 was roughly 1,060 [J/K], which was greater than that of the second external heat roller 54, which was roughly 600 [J/K].

The power, in terms of wattage, the halogen heater 40H of the fixation roller 40 was 1,200 W, and those of the halogen heaters 53H and 54H of the external heat rollers 53 and 54, respectively, were both 500 W. As described previously, the temperature adjustment circuit 43 adjusted the amount of electric power supplied to the halogen heaters 53H and 54H in such a manner that the surface temperature of the external heat rollers 53 and 54 converged to the same target level, which was 230° C.

Experiments were carried out to compare the first and second comparative fixing apparatuses with the fixing apparatus in accordance with the present invention, in terms of the temperature drop in the heating nip N. In the experiments, the speed (process speed) at which the recording medium P was conveyed through the heating nip N was 300 mm/sec, and the recording medium P was thick paper which was 250 g/m$^2$ in basis weight. The powers, in terms of wattage, of the halogen heaters 53H and 54H of the external heat rollers 53 and 54, respectively, were both 500 V, which was high enough to keep the surface temperature of fixation roller 40 no less than 150° C. even when multiple sheets of paper which were 250 g/m$^2$ in basis weight were continuously conveyed through the heating nip N.

In a case where the image forming apparatus 100 is a copy machine as shown in FIG. 1, as a start button of the control panel 108 is pressed when the apparatus 100 is on standby as shown in FIG. 4(*b*), an image formation start signal is inputted into the control portion 110. In a case where the image forming apparatus 100 is a printer connected (networked) to external devices such as a personal computer, an image formation signal is inputted into the control portion 110 by a print command from the external devices.

Next, referring to FIG. 5, as an image formation start signal is inputted into the control portion 110, preparatory operations for image formation are started by the various devices in the image forming apparatus 100, including the preparatory operation for fixation by the fixing apparatus 9 (S11). As soon as the temperatures of the fixation roller 40 and pressure roller 41 reach their target levels through the preparatory operation (S11) for fixation (YES in S12), an image forming operation is started.

The fixing apparatus 9 starts its fixing operation with the same timing as the timing with which the black image forming portion Pd begins to expose the peripheral surface drum 3*d* (S13). To describe this in more detail, the pressure roller 41 is placed in contact with the fixation roller 40 a preset length of time after the beginning of the exposure of the photosensitive drum 3*d* in the image forming portion Pd (S16). The timing with which the recording medium P is conveyed to the secondary transfer portion T2, that is, the timing with which the recording medium P begins to be conveyed by the pair of registration rollers 12, is set based on the timing with which the photosensitive drum 3*d* begins to be exposed in the image forming portion Pd.

When the fixing apparatus 9 is on standby, the first and second external heat rollers (53 and 54) remain positioned so that they can be individually placed in contact with the heating member (40) as shown in FIG. 4(*b*). Then, as the image formation start signal is inputted into the control portion 110, the second external heat roller 54 is placed in contact with the fixation roller 40 (S15) slightly before the first external heat roller 53 is placed in contact with the fixation roller 40 (S14). That is, when the image heating operation is started, the second external heating member (54), the first external heating member (53), and the pressing member (41) are placed in contact with the heating member (40) in the order in which they are mentioned.

Therefore, heat begins to be conducted from the second external heat roller 54 to the fixation roller 40 before heat begins to be conducted from the first external heat roller 53 to the fixation roller 40. Therefore, the temperature of the second external heat roller 54, which is detected by the thermistor 42*d*, becomes lower than the target level (230° C.). Thus, the halogen heater 54H is turned on before the halogen heater 53H is turned on.

Further, since the external heat rollers 53 and 54 are not simultaneously placed in contact with the fixation roller 40, it does not occur that the fixation roller 40 is suddenly changed in surface temperature, across particular areas of its peripheral surface, by being heated by both external heat rollers 53 and 54. Therefore, the fixation roller 40 remains a minimum in temperature nonuniformity in terms of its rotational direction, while fixing a toner image on the recording medium. Therefore, the image forming apparatus 100 outputs images which are satisfactory in fixation and uniform in glossiness.

As soon as an intended number of copies are outputted (YES in S17), the external heat rollers 53 and 54 and the pressure roller 41 are separated from the fixation roller 40 as shown in FIG. 3 (S18). Then, the electric power supply to the halogen heaters 53H, 54H, 40H, and 41H is stopped (S19), and the image forming apparatus 100 is kept on standby until the image formation start signal for the next job is inputted.

Next, referring to FIG. 6, when ordinary paper which was 80 g/m$^2$ in basis weight was conveyed through the heating nip N, it was possible to keep the drop in the surface temperature of the first external heat roller 53 below 10° C., and the amount $\Delta T$ of the fluctuation of the surface temperature of the fixation roller 40 below 15° C.

Next, referring to FIG. 7, when thick paper which was 250 g/m$^2$ in basis weight was conveyed through the heating nip N, it was possible to keep the drop in the surface temperature of the first external heat roller 53 below 20° C. Further, the surface temperature of the fixation roller 40 remained to be no less than 150° C., which is mandatory for satisfactory fixation.

To describe this in more detail, the pressure roller 41 was placed in contact with the fixation roller 40 roughly 10 seconds after the second external heat roller 54 was placed in contact with the fixation roller 40. The recording medium P was conveyed to the heating nip N with such timing that it arrived at the heating nip N roughly the same time as the pressure roller 41 was placed in contact with the fixation roller 40. As the peripheral surface layer of the fixation roller 40 dropped in temperature by coming into contact with the pressure roller 41 and the recording medium P, it came into contact with the first external heat roller 53 and absorbed heat from the external heat roller 53, whereby it was prevented from critically dropping in temperature. The first external roller 53, which was greater in thermal capacity, increased in surface temperature, and therefore, it efficiently heated the fixation roller 40.

In the first embodiment, making the external heat rollers 53 and 54 different in thermal capacity by no less than 100 [J/K] was effective to prevent the image forming apparatus 100 from outputting images which are inconsistent in fixation and glossiness. In other words, it was possible to make the external heat rollers 53 and 54 different in thermal capacity from each other, while keeping the same in structure the fixation roller 40, the pressure roller 41, the external heat rollers 53 and 54, the contact/separation mechanisms, and the frame/shell, as those of conventional fixing apparatuses.

In the first embodiment, the first external heat roller 53 is relatively large in thermal capacity. Therefore, it is unlikely to occur that the surface temperature of the external heat roller 53 significantly decreases immediately after the starting of an operation in which multiple copies are continuously outputted (which hereafter will be referred to simply as continuous image forming operation). Therefore, the first external heat roller 53 can continuously supply the fixation roller 40 with the necessary amount of heat throughout the continuous image forming operation. Further, the external heat roller 53 is relatively large in diameter. Therefore, the length of time its surface receives heat from its center per rotation is relatively long. This also makes it less likely for the surface temperature of the external heat roller 53 to significantly decrease. Therefore, a sufficient amount of heat is conducted from the external heat roller 53 onto the surface of the fixation roller 40, making it unlikely for the surface temperature of the fixation roller 40 to significantly decrease during the continuous image forming operation. Further, even if the surface temperature of the fixation roller 40 decreases through its contact with thick paper, the amount the surface temperature decreases remains within the range in which the fixing apparatus 9 can continue satisfactory fixation.

Also in the first embodiment, the difference in thermal capacity between the external heat rollers 53 and 54 was created by making the combination of the diameter and material of the two rollers 53 and 54 different from each other. However, the difference may be created by making the two roller 53 and 54 different in only one of these two parameters. For example, the first external heat roller 53 may be made greater in thermal capacity than the second external heat roller 54, by increasing the thickness of the metallic core 53*b* of the first heat roller 53.

However, if the external heat roller 53 is structured so that it is drastically smaller in the thermal conduction in its thickness direction, it is difficult for the internal heat (from halogen heater) to reach the peripheral surface of the external heat roller 53, and therefore, it is difficult to keep the surface temperature of the external heat roller 53 close to the target level, which in turn makes it possible for the metallic core 40*a* and/or halogen heater 54H to be heated beyond the highest levels they can withstand. In the first embodiment, therefore, increasing the external heat roller 53 in diameter beyond the abovementioned value is undesirable, because it will make it impossible to fit the external heat roller 53 (fixing apparatus) in the frame (shell) of the fixing apparatus 9. Further, it is also undesirable to increase the external heat roller 53 in its thickness beyond the above-mentioned value, because it will reduce the amount of which heat conducted from the halogen heater 53H to the peripheral surface of the external heat roller 53, which in turn reduces the external heat roller 53 in terms of its response to the changes in its surface temperature.

<Comparative Fixing Apparatus 1>

Figure 8:
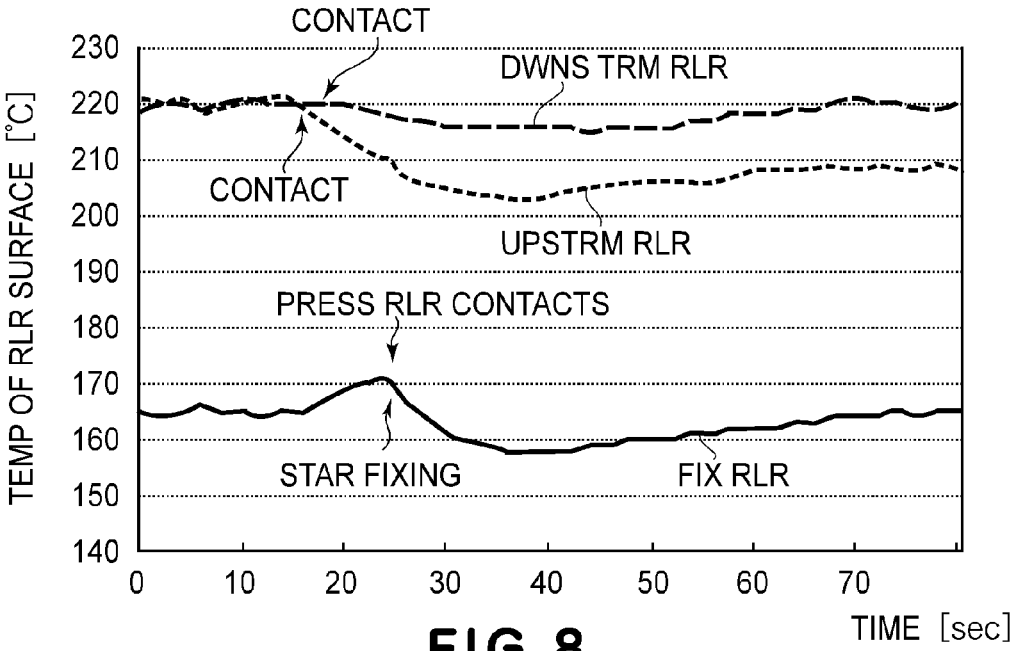
FIG. 8 is a graph which shows the relationship between the fluctuation in the surface temperature of the fixation roller of the fixing apparatus in the first comparative fixing apparatus, which occurred when multiple sheets of ordinary paper were conveyed through the fixation nip for the fixation of the images thereon, and the elapse of time.
Figure 9:
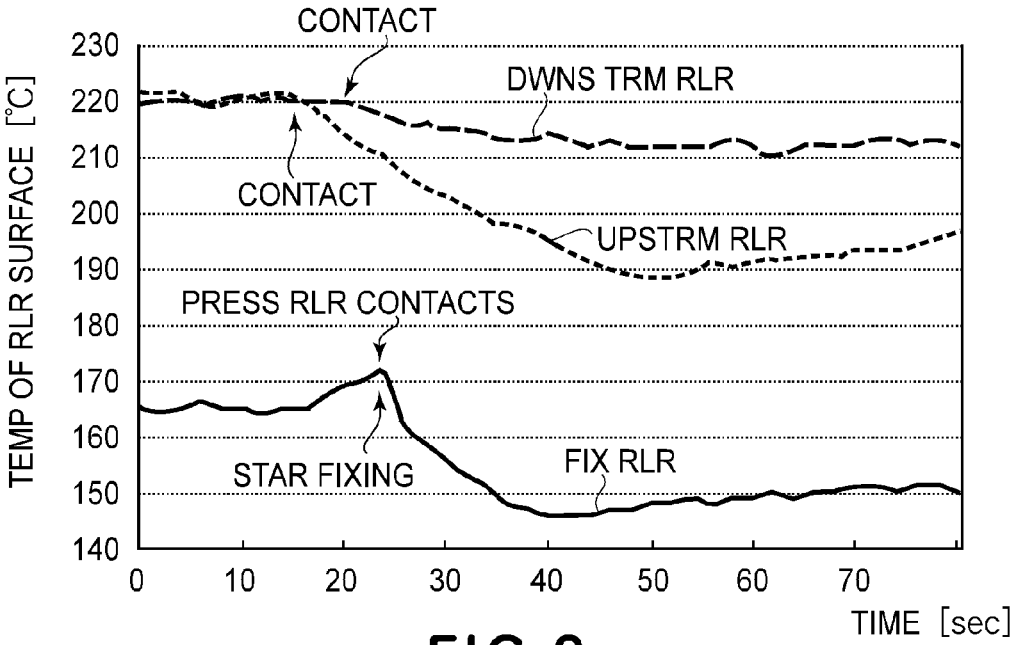
FIG. 9 is a graph which shows the relationship between the fluctuation in the surface temperature of the fixation roller of the image heating apparatus in the first comparative fixing apparatus, which occurred when multiple sheets of thick paper were conveyed through the fixation nip for the fixation of the images thereon, and the elapse of time.

FIG. 8 is a graph which shows the relationship between the fluctuation of the surface temperature of the fixation roller in the first comparative fixing apparatus, which occurred when multiple sheets of ordinary paper were conveyed through the fixation nip for the fixation of the images thereon, and the elapse of time. FIG. 9 is a graph which shows the relationship between the fluctuation of the surface temperature of the fixation roller in the first comparative fixing apparatus, which occurred when multiple sheets of thick paper were conveyed through the fixation nip for the fixation of the images thereon, and the elapse of time.

For the comparison of this comparative fixing apparatus with the image heating apparatus in the first embodiment, this fixing apparatus was structured so that it was the same in metallic cores, appearance, halogen heaters, and their combination, as the fixing apparatus 9 in the first embodiment. Then, this comparative fixing apparatus was evaluated in the same manner as the manner in which the fixing apparatus in the first embodiment was evaluated.

In the case of this fixing apparatus, its external heat rollers 53 and 54 also were made of a metallic core and a fluorinated resin (PFA) layer. The metallic core was a piece of aluminum cylinder which was 36 mm in diameter and 3.0 mm in thickness (AL6063: 2.7 in specific gravity, and 900 [J/kg·K] in specific heat). The fluorinated resin was coated on the peripheral surface of the metallic core to a thickness of roughly 20 μm. As for the first external heat roller 53, it also was made up of a metallic core and a fluorinated resin (PFA) layer. Thus, both external heat rollers 53 and 54 were 600 [J/K] in thermal capacity; they are the same in thermal capacity. Also like the image heating apparatus in the first embodiment, the powers, in terms of wattage, of the halogen heaters 53H and 54H of the external heat roller 53 and 54, respectively, were both 500 W. Further, the target level for the surface temperature of the external heat roller 53 and that for the external heat roller 54 were both 230° C. The conditions under which this comparative fixing apparatus were operated, were the same as those under which the fixing apparatus 9 in the first embodiment was operated.

Referring to FIG. 8, when the recording medium P conveyed through the heating nip N was ordinary paper that was 80 g/m$^2$ in basis weight, the surface temperature of the external heat roller 53 decreased by as much as 20° C., but, the amount ΔT of the fluctuation of the surface temperature of the fixation roller 40 remained below 20° C. Further, the surface temperature of the fixation roller 40 remained to be no less than 150° C., which is mandatory for satisfactory fixation.

Next, referring to FIG. 9, in comparison, as thick paper that was 250 g/m$^2$ in basis weight was conveyed through the heating nip N, the surface temperature of the first external heat roller 53 very quickly dropped, by as much as 30° C. Consequently, the surface tempature of the fixation roller 40 became lower than 150° C., which is necessary to ensure that developer is properly fixed, creating a serious problem that the image forming apparatus 100 outputted images which were unsatisfactory in fixation and glossiness.

However, the second external heat roller 54 dropped in surface temperature only by roughly 10° C., which was virtually negligible. Thus, it is reasonable to think that in the case of this comparative fixing apparatus, the employment of two external heat rollers 53 and 54 did not work as effectively as it did in the first embodiment.

<Comparative Fixing Apparatus 2>

Figure 10:
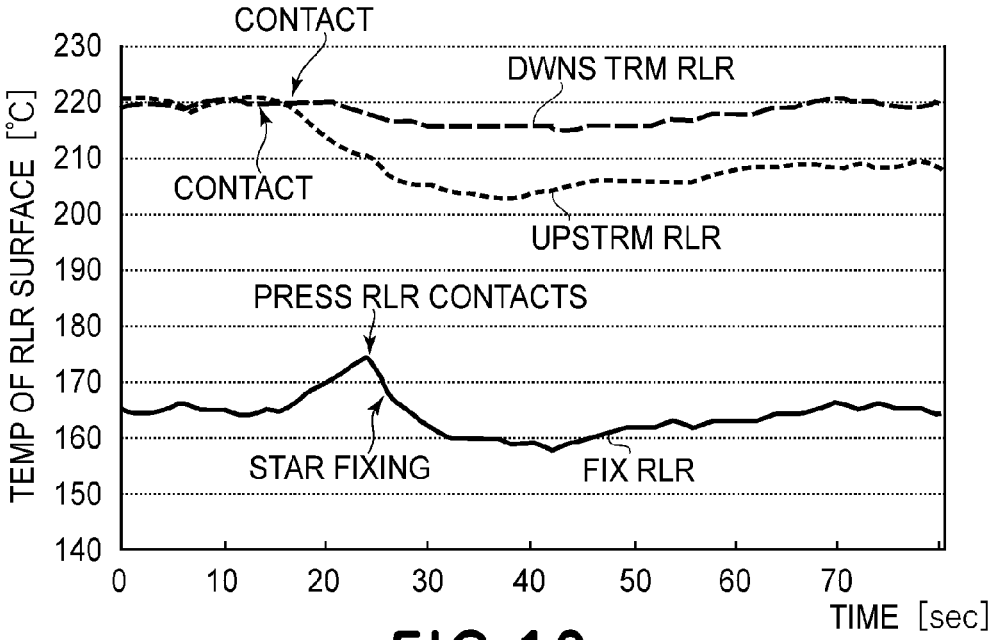
FIG. 10 is a graph which shows the relationship between the fluctuation in the surface temperature of the fixation roller of the fixing apparatus in the second comparative fixing apparatus, which occurred when multiple sheets of ordinary paper were conveyed through the fixation nip for the fixation of the images thereon, and the elapse of time.
Figure 11:
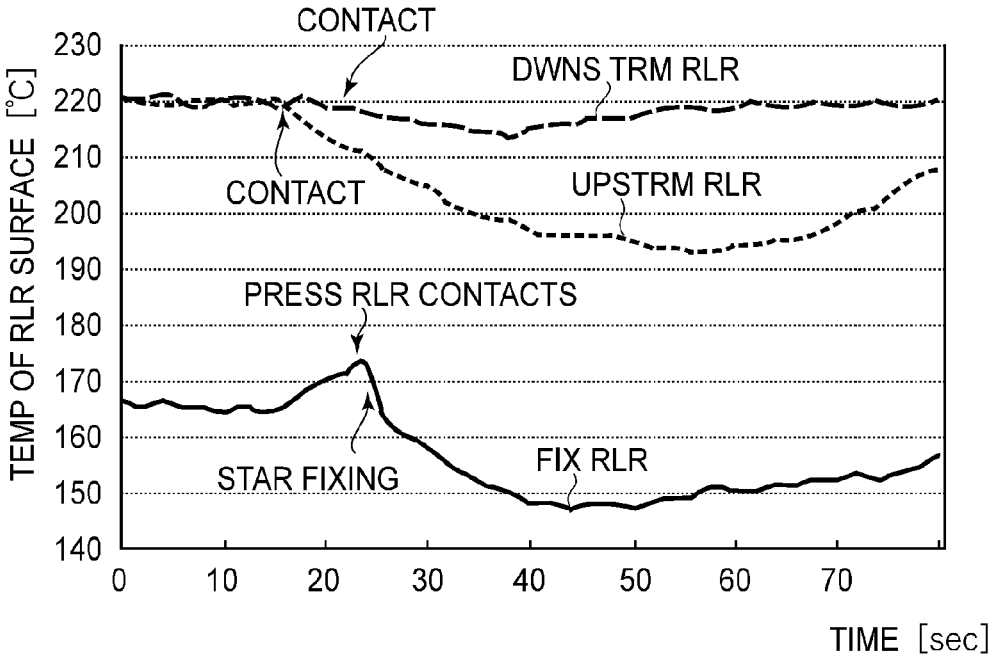
FIG. 11 is a graph which shows the relationship between the fluctuation in the surface temperature of the fixation roller of the fixing apparatus in the second comparative fixing apparatus, which occurred when multiple sheets of thick paper were conveyed through the fixation nip for the fixation of the images thereon, and the elapse of time.

FIG. 10 is a graph which shows the relationship between the fluctuation of the surface temperature of the fixation roller of the second comparative fixing apparatus, which occurred when multiple sheets of ordinary paper were conveyed through the fixation nip for the fixation of the images thereon, and the elapse of time. FIG. 11 is a graph which shows the relationship between the fluctuation of the surface temperature of the fixation roller of the second comparative fixing apparatus, which occurred when multiple sheets of thick paper were conveyed through the fixation nip for the fixation of the images thereon, and the elapse of time.

For the study of the positioning of the external heat rollers 53 and 54, the second comparative fixing apparatus, which reverses the positioning of the external heat rollers 53 and 54, was created. Then, this comparative fixing apparatus was evaluated in the same manner as the fixing apparatus 9 in the first embodiment was evaluated. Then, the results of the evaluation of this fixing apparatus were compared with those of the fixing apparatus in the first embodiment.

In the case of the second comparative fixing apparatus, the thermal capacity of the second external heat roller 54 was greater than the first external heat roller 53, unlike in the first embodiment. More concretely, the second external heat roller 54 in the first embodiment, which had a smaller heat capacity than the first external heat roller 53 in the first embodiment, was used as the first external heat roller 53 in the second comparative fixing apparatus, and the first external heat roller 53 in the first embodiment, which had a larger thermal capacity than the second external heat roller 54 in the first embodiment, was used as the second external heat roller 54 of the second comparative fixing apparatus. Thus, the thermal capacity of the first external heat roller 53 of the second comparative fixing apparatus was roughly 600 [J/K], which was smaller than that of the second external heat roller 54 of the second comparative fixing apparatus, which was roughly 1,060 [J/K].

In terms of the structure of the external heat rollers 53 and 54, the wattage and the temperature control of halogen heaters 53H, 54H of the second comparative fixing apparatus was made the same as the fixing apparatus 9 in the first embodiment. Further, the conditions under which this comparative fixing apparatus was operated to be compared with the fixing apparatus 9 in the first embodiment were the same as those under which the fixing apparatus 9 in the first embodiment was operated for evaluation.

Referring to FIG. 10, when the recording medium P conveyed through the heating nip N was ordinary paper that was 80 g/m$^2$ in basis weight, the surface temperature of the external heat roller 53 decreased by as much as 20° C., but, the amount ΔT of the fluctuation of the surface temperature of the fixation roller 40 remained below 20° C. Further, the surface temperature of the fixation roller 40 continued to be no less than 150° C., which is mandatory for satisfactory fixation.

Next, referring to FIG. 11, however, as thick paper that was 250 g/m$^2$ in basis weight was conveyed through the heating nip N, the surface temperature of the first external heat roller 53 very quickly dropped, by as much as 30° C. Consequently, the surface temperature of the fixation roller 40 became lower than 150° C., which is necessary to ensure that developer is properly fixed, creating a serious problem that the image forming apparatus 100 outputted images unsatisfactory in fixation and glossiness.

Also in the case of the second comparative fixing apparatus, there was virtually no drop in the surface temperature of the second external heat roller 54. Thus, it is reasonable to think that like the case of the first comparative fixing apparatus, the employment of two external heat rollers 53 and 54 did not work as effectively as it did in the first embodiment.

<Comparative Fixing Apparatus 3>

An external heat roller (54), which is different only in the metallic core material from the second external heat roller 54 of the second comparative fixing apparatus, was created; it was the same in diameter and thickness as the external heat roller 54 of the second comparative fixing apparatus. That is, its metallic core was made of aluminum (AL6063: 900 [J/kg·K] in specific heat). Then, this external heat roller (54) was mounted in the second comparative fixing apparatus to create the third comparative fixing apparatus. Then, the third comparative fixing apparatus was evaluated in the same manner as the fixing apparatus in the first embodiment was evaluated.

The third comparative fixing apparatus was slightly better than the second comparative fixing apparatus, in terms of the drop in surface temperature of the fixation roller 40. However, the surface temperature of the fixation roller 40 became excessively high right after sheets of ordinary paper, which were 80 g/cm$^2$ in basis weight, began to be conveyed through the heating nip N, creating therefore a problem that the outputted images were seriously unsatisfactory. That is, the third comparative fixing apparatus was significantly larger in the amount of toner transferred onto the fixation roller 40, resulting in the outputting of images that were nonuniform in density, and also, in the frequency of occurrence of paper jams attributable to the phenomenon that the recording medium P sticks to fixation roller 40 and rotates therewith.

Further, when sheets of thick paper that were 250 g/m$^2$ in basis weight were conveyed through the heating nip N, the fixation roller 40 drastically dropped in surface temperature by the time several tens of sheets were conveyed through the heating nip N. In other words, this comparative fixing apparatus was not as good in performance and stability as the first comparative fixing apparatus.

<Comparative Fixing Apparatus 4>

Another comparative fixing apparatus was created by replacing the external heat rollers 53 and 54 of the first comparative fixing apparatus, with the same external heat rollers as the first external heat roller 53 in the first embodiment, that is, the one whose metallic core was made of stainless steel. This fixing apparatus was used as the fourth comparative fixing apparatus.

That is, the metallic core of each of the external heat rollers 53 and 54 of the fourth comparative fixing apparatus was a piece of hollow stainless steel cylinder that was 44 mm in diameter and 3.0 mm in thickness. The metallic cores were roughly 1,060 [J/K] in thermal capacity. The powers, in terms of wattage, of the halogen heaters 53H and 54H of the external heat rollers 53 and 54, respectively, of this fixing apparatus were both 500 W. The halogen heaters 53H and 54H were controlled in such a manner that the surface temperature of the external heat rollers 53 and 54 converge to the target temperature level of 230° C.

The fourth comparative fixing apparatus was evaluated in the same manner as the fixing apparatus in the first embodiment was evaluated. When sheets of thick paper that were 250 g/m$^2$ in basis weight were conveyed through the heating nip N, the fourth comparative fixing apparatus was just as good and stable in fixation performance as the fixing apparatus in the first embodiment. However, when sheets of ordinary paper that were 80 g/m$^2$ in basis weight were conveyed through the heating nip N, the surface temperature of the fixation roller 40 reached 180° C., which was higher by 15° C. than the target level, immediately after the sheets of ordinary paper began to be conveyed. Further, the amount of difference ΔT between the highest and lowest temperature levels of the surface temperature of the fixation roller 40 became no less than 25° C., creating therefore various problems, for example, the problem that image forming apparatus 100 outputted images which were nonuniform in glossiness.

Given in Table 1 are the results of the comparative evaluation among the fixing apparatus in the first embodiment, and first to fourth comparative fixing apparatuses.

TABLE 1

| | External Heating apacity | | Temperature Variation of Fixing Roller | | | Fixing Properties | |
|---|---|---|---|---|---|---|---|
| | Upstrm | Dwnstrm | Initial | T. Down | Gloss Vaiation | Thin Sheet | Thick Sheet |
| Emb. 1 | Large | Small | G | G | G | G | G |
| Comp. 1 | Small | Small | G | NG | F | G | NG |
| Comp. 2 | Small | Large | G | NG | F | F | NG |
| Comp. 3 | Large | Large | NG (high) | G | NG | NG | G |

G: Good.
F: Fair.
NG: No good.

In the first embodiment, the fixing apparatus 9 was structured so that the relationship in terms of thermal capacity and positioning between its external heat rollers 53 and 54 became as described above. Consequently, it was possible to obtain far greater effects than those obtainable by simply increasing the external heat rollers 53 and 54 in thermal capacity. That is, it was possible to increase the surface temperature of the fixation roller 40 only across the areas which were necessary to be increased in temperature. Therefore, the fluctuation of the temperature of the heating nip N of the fixing apparatus was minimized when sheets of ordinary paper that were 80 g/cm$^2$ were conveyed through the heating nip N, as well as when sheets of thick paper that were 250 g/m$^2$ were conveyed through the heating nip N. Thus, the fixing apparatus remained satisfactory in fixation and glossiness.

<Embodiment 2>

In the first embodiment, the temperature of the heating nip N was prevented from significantly decreasing during the initial stage of an image forming apparatus in which the recording medium P was relatively large in basis weight, by making the first external heat roller 53 larger in thermal capacity than the second external heat roller 54.

In the second embodiment, the image heating apparatus was enabled to deal with recording media which were substantially greater in basis weight than the recording medium with which the image heating apparatus in the first embodiment was able to deal, by making the halogen heater 53H, which was the heat source of the first external heat roller 53, larger in wattage than the halogen heater 54H of the second external heat roller 54.

Referring to FIG. 2, the greater the recording medium P in basis weight, the greater the amount of heat absorbed by the recording medium P from the fixation roller 40, and therefore, the more likely the temperature of the fixation roller 40 becomes insufficient for fixation. One of the methods thinkable as the solution to this problem is to increase in wattage of the halogen heater 40H which is the heat source of the fixation roller 40. However, simply increasing the wattage of the halogen heater 40H results in the problem that it makes it difficult to control the temperature of the fixation roller 40 (in particular, its metallic core) during the initial period of a continuous image forming operation, that is, an image forming operation in which a substantial number of prints are continuously made.

Further, if the total amount of heat supplied to the fixing roller 40 becomes insufficient during a continuous image forming operation, the surface temperature of the fixation roller 40 gradually decreases, eventually making the fixing apparatus unable to satisfactorily fix toner images. There is a limit in the wattage of the halogen heater 40H which is in the internal hollow of the metallic core 40*b* of the fixation roller 40. Therefore, if it is only the halogen heater 40H that heats the fixation roller 40, the amount of heat supplied to the fixation roller 40 sometimes becomes insufficient. Another reason why the surface temperature of the fixation roller 40 gradually decreases is that the speed with which the heat from the halogen heater 40H is conducted to the surface layer of the fixation roller 40 is slow.

Thus, it is reasonable to think of increasing the amount of heat supplied by the external heat rollers 53 and 54 to the fixation roller 40. However, increasing the amount of heat supplied to the fixation roller 40 by the second external heat roller 54 makes it easier for the surface temperature of the external heat roller 54 to reach the target level. Therefore, when a substantial number of sheets of recording medium P are continuously conveyed through the heating nip N, the halogen heater 54H is likely to be frequently turned off, being therefore ineffective to heat the fixation roller 40. In addition, it is possible that if the intervals with which the recording mediums P are conveyed happens to become wrong (longer than preset value) when the surface temperature of the external heat roller 54 is at the target level (230° C.), the surface temperature of the fixation roller 40 will overshoot the target value (160° C.) by a large margin.

As a solution to this problem, it is effective to increase the amount of heat supplied to the fixation roller 40, by increasing in wattage the halogen heater 53H, which is the heat source of the external heat roller 53, which is the first external heating member. More specifically, the temperature difference between the external heat roller 53 and the surface of the fixation roller 40 is large. Therefore, the drop in temperature of the external heat roller 53 is large when its heat is robbed by the fixation roller 40. Therefore, the halogen heater 53H is likely to be kept turned on, being capable of more effectively heating the peripheral surface of the fixation roller 40 by increasing the electric power consumption by an amount equal to the amount by which the wattage limit of the halogen heater 40 was increased.

In the second embodiment, the halogen heater 53H, which is the heat source of the first external heat roller 53, is greater in wattage than the halogen heater 54H, which is the heat source of the second external heat roller 54 and which is on the downstream side of the first external heat roller 53. More specifically, the halogen heater 53H, which is 500 W in power was replaced with a halogen heater which is 800 W in power in order to make the halogen heater 53H different in power from the halogen heater 54H which is 500 W in power.

Otherwise, the fixation roller 40, the pressure roller 41, and the external heat rollers 53 and 54 in the second embodiment are the same in the temperature control and the control for placing the pressure roller 41, and the external heat rollers 53 and 54 in contact with, or separating them from, the fixation roller 40. The basis weight range of the recording media used for the continuous image forming operation to evaluate the fixing apparatus in the second embodiment was wider than the basis weight range of the recording media used for the continuous image forming operation to evaluate the fixing apparatus in the first embodiment. The recording-medium conveyance speed for fixation was 300 mm/sec. Regarding the basis weight of the recording medium P, sheets of a recording medium P which were 64 g/m$^2$, and sheets of a recording medium P which were 310 g/m$^2$, were used in addition to the sheets of a recording medium P which were 80 g/m$^2$ and the sheets of a recording medium P which were 250 g/m$^2$.

TABLE 2

| | External Heating. Wattage | | Basis Weight (g/m^2) Gloss Variation Fixing Properties | | | |
|---|---|---|---|---|---|---|
| | Upstrm | Dwnstrm | 64 | 80 | 200 | 310 |
| Emb. 1 | Large | Small | F | G | G | NG |
| Emb. 2 | Small | Small | G | G | G | G |

G: Good.
F: Fair.
NG: No good.

As will be evident from Table 2, the second embodiment made a fixing apparatus wider in terms of the basis weight range of the recording media than the first embodiment, while ensuring that the fixing apparatus in the second embodiment remained just as good as the fixing apparatus in the first embodiment, in terms of fixation and consistency in glossiness. More specifically, the image fixing apparatus in the second embodiment outputted satisfactory copies using sheets of a recording medium which were 64 g/m$^2$ in basis weight, and sheets of a recording medium which were 310 g/m$^2$ in basis weight, in addition to the sheets of a recording medium which were 80 g/m$^2$ in basis weight and sheets of a recording medium which were 250 g/m$^2$.

In summary, the first and second embodiments of the present invention made it possible to provide image fixing apparatuses that reliably fix toner images on a wide range of recording media in terms of basis weight, at a high level image quality, by minimizing the fluctuation of the surface temperature of the fixation roller 40. Thus, they made it possible to provide image forming apparatuses that reliably output images that are accurate and uniform in glossiness. Further, they made it possible to more effectively distribute (conduct) heat from the halogen heaters 53H and 54H to the external heat rollers 53 and 54, respectively, thereby minimizing the amount of heat wasted from the halogen heaters 53H and 54H. Thus, they make it possible to provide image forming apparatuses that can reliably output images of high quality even when they are used for an image forming operation in which a substantial number of copies are to be continuously made.

According to the present invention, a fixing apparatus (9) is provided with external heat rollers (53) and (54), which are different in thermal capacity and heating performance, like the fixing apparatuses in the first and second embodiments. Therefore, a sudden increase or decrease in the temperature of the fixation roller 40 of the fixing apparatus (9) in accordance with the present invention is minimized. Thus, when the recording medium P is thick paper, the fixing apparatus (9) in accordance with the present invention is significantly greater in productivity than any of conventional fixing apparatuses. Thus, the present invention can provide image forming apparatuses that can output color images which are high in quality in that they are uniform in glossiness.

In the case of an image heating apparatus in accordance with the present invention, as the surface temperature of the heating member decreases by coming into contact with the recording medium, it is heated by coming into contact with the first external heating member, which is relatively large in heat capacity, and then, it is heated by coming into contact with the second external heat roller, which is relatively small in thermal capacity. The external heating member that is relatively large in thermal capacity experiences a relatively small reduction in surface temperature as it comes into contact with the heating member that is lower in surface temperature than the external heating member. Therefore, it can give more heat to the heating member than the external heating member which is smaller in thermal capacity. Further, it takes longer for heat to conduct from its heat source to the heating nip N than the external heating member which is smaller in thermal capacity. Therefore, the heat given to it by its heat source reaches the heating nip N after being more evenly distributed in a direction perpendicular to the depth direction of the heating member.

Therefore, more heat is supplied to the heating member, making the heating member higher in temperature, across the portion of its peripheral surface, which is in the heating nip. Thus, the present invention can very effectively minimize a fixing (heating) apparatus in which multiple external heat rollers are in the immediate adjacencies of its heat roller, in the temperature drop in the heating nip, which occurs as a recording medium is moved through the nip, while keeping the fixing (heating) apparatus virtually the same in structure as conventional fixing apparatuses having multiple external heat rollers.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 164846/2009 filed Jul. 13, 2009 which is hereby incorporated by reference.

What is claimed is:

1. A fixing apparatus comprising:

a fixing member configured and positioned to fix an unfixed toner image on a sheet at a nip portion;

a nip forming member configured and positioned to form the nip portion cooperatively with said fixing member;

a first external heating member configured and positioned to heat an external surface of said fixing member by contacting the external surface of said fixing member at a first heating position; and a second external heating member provided at a position which is upstream of the nip portion and is downstream of the first heating position in a rotational direction of said fixing member, and configured and positioned to heat an external surface of said fixing member by contacting the external surface of said fixing member at a second heating position, wherein said first external heating member has a thermal capacity larger than said second external heating member.

2. A fixing apparatus according to claim 1, wherein a difference of the thermal capacity between said first external heating member and said second external heating member is not less than 100 J/K.

3. A fixing apparatus according to claim 2, wherein said first external heating member has a hollow metal core whose thickness is larger than that of a hollow metal core of said second external heating member.

4. A fixing apparatus according to claim 3, wherein said first external heating member includes a fluororesin layer provided on said hollow metal core, and said second external heating member includes a fluororesin layer provided on said hollow metal core.

5. A fixing apparatus according to claim 1, wherein said first external heating member has a hollow metal core whose thickness is larger than that of a hollow metal core of said second external heating member.

6. A fixing apparatus according to claim 2, wherein said first external heating member has a hollow metal core whose diameter larger is than that of a metal core of said second external heating member.

7. A fixing apparatus according to claim 6, wherein said first external heating member includes a hollow metal core, and said second external heating member includes a hollow metal core which has a specific heat is different from that of said hollow metal core of said first external heating member.

8. A fixing apparatus according to claim 7, wherein said first external heating member includes a hollow cylindrical material of stainless steel, and said second external heating member includes a hollow cylindrical material of aluminum.

9. A fixing apparatus according to claim 8, wherein said first external heating member includes a fluororesin layer provided on said hollow metal core, and said second external heating member includes a fluororesin layer provided on said hollow metal core.

10. A fixing apparatus according to claim 1, wherein said first external heating member has a hollow metal core of which a diameter larger is than that of a metal core of said second external heating member.

11. A fixing apparatus according to claim 1, wherein said first external heating member includes a hollow metal core, and said second external heating member includes a hollow metal core which has a specific heat is different from that of said hollow metal core of said first external heating member.

12. A fixing apparatus according to claim 11, wherein said first external heating member includes a hollow cylindrical material of stainless steel, and said second external heating member includes a hollow cylindrical material of aluminum.

13. A fixing apparatus according to claim 1, further comprising a moving mechanism configured and positioned to independently move said first and second external heating members toward and away from said fixing member, and a controller configured to cause said second external heating member and said first external heating member to contact to said fixing member in the order named, upon start of a fixing process.

14. A fixing apparatus according to claim 1, wherein said fixing member is a fixing roller.

15. A fixing comprising:

a fixing member configured and positioned to fix an unfixed toner image on a sheet at a nip portion;

a nip forming member configured and positioned to form the nip portion cooperatively with said fixing member;

a first external heating roller configured and positioned to heat an external surface of said fixing member by contacting the external surface of said fixing member at a first heating position;

a second external heating roller provided at a position which is upstream of the nip portion and is downstream of the first heating position in a rotational direction of said fixing member and configured and positioned to heat an external surface of said fixing member by contacting the external surface of said fixing member at a second heating position, wherein said first external heating roller has a hollow metal core whose thickness is larger than that of a hollow metal core of said second external heating roller so that the thermal capacity of said first external heating roller is larger than that of said second external heating roller.

16. A fixing apparatus according to claim 15, wherein a difference of the thermal capacity between said first external heating roller and said second external heating roller is not less than 100 J/K.

17. A fixing apparatus according to claim 15, further comprising a moving mechanism configured and positioned to independently move said first and second external heating rollers toward and away from said fixing member, and a controller configured to cause said second external heating roller and said first external heating roller to contact to said fixing member in the order named, upon start of a fixing process.

18. A fixing apparatus comprising:

a fixing member configured and positioned to fix an unfixed toner image on a sheet at a nip portion;

a nip forming member configured and positioned to form the nip portion cooperatively with said fixing member;

a first external heating roller configured and positioned to heat an external surface of said fixing member by contacting the external surface of said fixing member at a first heating position; and a second external heating roller provided at a position which is upstream of the nip portion and is downstream of the first heating position in a rotational direction of said fixing member and configured and positioned to heat an external surface of said fixing member by contacting the external surface of said fixing member at a second heating position, wherein said first external heating roller has a hollow metal core whose diameter is larger than that of a hollow metal core of said second external heating roller so that the thermal capacity of said first external heating roller is larger than that of said second external heating roller.

19. A fixing apparatus according to claim 18, wherein a difference of the thermal capacity between said first external heating roller and said second external heating roller is not less than 100 J/K.

20. A fixing apparatus according to claim 18, further comprising a moving mechanism configured and positioned to independently move said first and second external heating rollers toward and away from said fixing member, and a controller configured to cause said second external heating roller and said first external heating roller to contact to said fixing member in the order named, upon start of a fixing process.

* * * * *